US010457430B2

(12) United States Patent
Daniel et al.

(10) Patent No.: US 10,457,430 B2
(45) Date of Patent: Oct. 29, 2019

(54) APPARATUS FOR COUPLING PLASTIC CAN CARRIERS TO CANS

(71) Applicant: American Canning Machines, LLC, Austin, TX (US)

(72) Inventors: Michael T. Daniel, Austin, TX (US); Donna H. Daniel, Austin, TX (US); David C. Racino, Austin, TX (US)

(73) Assignee: American Canning Machines, LLC, Austin, TX (US)

( * ) Notice: Subject to any disclaimer, the term of this patent is extended or adjusted under 35 U.S.C. 154(b) by 0 days.

(21) Appl. No.: 16/139,212

(22) Filed: Sep. 24, 2018

(65) Prior Publication Data

US 2019/0092502 A1 Mar. 28, 2019

Related U.S. Application Data

(60) Provisional application No. 62/562,209, filed on Sep. 22, 2017.

(51) Int. Cl.

| | |
|---|---|
| ***B65B 17/02*** | (2006.01) |
| ***B65B 43/44*** | (2006.01) |
| ***B65B 35/44*** | (2006.01) |

(52) U.S. Cl.

CPC ..... *B65B 17/025* (2013.01); *B65B 35/44* (2013.01); *B65B 43/44* (2013.01)

(58) Field of Classification Search

CPC ..... B65B 17/025; B65B 35/44; B65B 43/44; B65B 61/20; B65B 61/202; B65B 7/2807; B65B 7/2814

USPC ..... 53/398, 81, 471, 168, 158

See application file for complete search history.

(56) References Cited

U.S. PATENT DOCUMENTS 2,619,237 A * 11/1952 Socke ..... B65B 35/44 198/428
2,929,181 A * 3/1960 Ougljesa ..... B65B 17/025 53/247
2,936,558 A * 5/1960 Glazer ..... B65B 17/025 294/87.2
3,383,828 A * 5/1968 Cunningham ..... B65B 17/025 206/150
3,447,280 A * 6/1969 Cunningham ..... B01D 53/22 225/97

(Continued)

OTHER PUBLICATIONS

Video titled "PakTech Can Carrier Applicator CCA120", published online on Jan. 27, 2016, retrieved on Nov. 7, 2018 from URL https://www.youtube.com/watch?v=GFxsQghsqv8 (Year: 2016).*

(Continued)

*Primary Examiner* — Alexander M Valvis
*Assistant Examiner* — Valentin Neacsu
(74) *Attorney, Agent, or Firm* — Meyertons, Hood, Kivlin, Kowert & Goetzel, P.C.; Gareth M. Sampson

(57) ABSTRACT

An apparatus for coupling one or more can carriers to a plurality of cans is disclosed herein. The apparatus may include rails for guiding the cans as the cans move through the apparatus. Push members may be moved into the space between the rails to push the cans through the apparatus towards a member and at least one roller. The member (e.g., a hopper) may position a can carrier above the cans. The at least one roller may be positioned to provide a downward force on the can carrier to attach the can carrier to the top of the cans as the cans are moved past the at least one roller by the push members.

20 Claims, 16 Drawing Sheets

(56) References Cited

U.S. PATENT DOCUMENTS 3,488,911 A * 1/1970 Poupitch ..... B65B 17/025 53/170
3,660,961 A * 5/1972 Ganz ..... B65B 11/10 53/210
3,946,535 A * 3/1976 Bourgeois ..... B65B 17/025 53/398
4,079,571 A * 3/1978 Schlueter ..... B65B 17/025 198/418.1
4,116,331 A * 9/1978 Curry ..... B65B 17/025 206/150
4,711,065 A * 12/1987 Focke ..... B65B 11/32 53/170
4,817,361 A 4/1989 Cunningham
5,070,992 A * 12/1991 Bonkowski ..... B65G 47/088 198/419.1
5,088,269 A * 2/1992 Thelen ..... B65B 17/025 53/398
5,233,811 A * 8/1993 Odum ..... B65B 17/025 53/48.4
5,263,299 A * 11/1993 Galbierz ..... B65B 17/025 53/390
5,287,677 A * 2/1994 Hunter ..... B65B 17/025 53/398
5,542,231 A * 8/1996 Ungar ..... B65B 17/025 53/134.1
5,890,349 A * 4/1999 Heisler ..... B65B 57/02 53/314
6,170,225 B1 1/2001 Cervantes et al.
6,792,987 B2 * 9/2004 Monroe ..... B65H 19/1852 156/351
7,328,786 B2 * 2/2008 Anderson ..... B65G 21/2054 198/781.01
7,600,357 B2 10/2009 Jorissen et al.
9,815,579 B2 * 11/2017 Larsson ..... B65D 51/246
2007/0119691 A1 * 5/2007 Anderson ..... B65G 21/2054 198/782
2010/0154356 A1 6/2010 Elsperger
2012/0227361 A1 * 9/2012 Bates ..... B65B 17/025 53/443
2013/0042580 A1 * 2/2013 May ..... B65B 17/025 53/457
2013/0263557 A1 * 10/2013 Bates ..... B65B 17/025 53/398
2015/0121815 A1 * 5/2015 Larsson ..... B65D 51/246 53/471
2016/0096694 A1 * 4/2016 Baylor ..... B65B 5/06 414/774
2016/0270602 A1 * 9/2016 Casey ..... A47J 43/27
2016/0362256 A1 * 12/2016 Papsdorf ..... B65B 35/44
2017/0190488 A1 * 7/2017 Bates ..... B65B 17/025

OTHER PUBLICATIONS

Video titled "PakTech Can Carrier Applicator CCA280", published online on Jan. 27, 2016, retrieved on Nov. 7, 2018 from URL http://www.youtube.com/watch?v=2EqYFC8ZCag (Year: 2016).*
Video titled "PakTech Can Carrier Applicator CCA280", published online on Jan. 27, 2016, retrieved on Nov. 7, 2018 from URL https://www.youtube.com/watch?v=sCN_IpRJuOY (Year: 2016).*
PakTech CCA 120 Handle Applicator document, 2 pages (also viewed at https://paktech-opi.com/handle-applicators/cancarriers/#app).

* cited by examiner

APPARATUS FOR COUPLING PLASTIC CAN CARRIERS TO CANS

PRIORITY CLAIM

This patent claims priority to U.S. Provisional Patent Application No. 62/562,209 to Daniel, entitled "APPARATUS FOR COUPLING PLASTIC CAN CARRIER TO CANS", filed Sep. 22, 2017, which is incorporated by reference in its entirety.

BACKGROUND OF THE INVENTION

1. Field of the Invention

Embodiments disclosed herein relate to an apparatus for coupling can carriers to cans. Certain embodiments disclosed herein relate to an apparatus for coupling plastic can carriers to multiple aluminum cans in an automated process.

2. Description of the Relevant Art

Plastic can carriers/holders (such as PakTech® can carriers) are increasingly being used as carriers for multiple packs of cans (e.g., 4-packs ("quad packs), 6-packs, and/or 8-packs). The plastic can carriers allow the cans to be attached to each other and handled/shipped as a unit without the need for additional packaging material (e.g., boxes, cartons, and/or shrink-wrap). Additionally, the plastic can carriers are typically made with easily recyclable material (such as post-consumer recycled (PCR) HDPE (#2)) and have coverings for the tops of the can. Covering the tops of the can may keep the can tops clean and free of contaminants.

SUMMARY

In certain embodiments, an apparatus for coupling one or more can carriers to a plurality of cans includes rails for guiding the cans as the cans move through the apparatus. One or more stops may have stop members that are moved in and out of a space between the rails. The stop members, when inserted in the space between the rails, may provide a stop for the cans moving through the apparatus. One or more pushers may have push members that are moved in and out of the space between the rails. The push members, when positioned in the space between the rails, may be used to move the cans along a path between the rails. A member (e.g., hopper) may position at least one can carrier on top of the cans. At least one roller may provide downward force on the can carrier to attach the can carrier to the cans as the cans move past the at least one roller.

In certain embodiments, a method includes moving a plurality of cans along a path between a pair of rails. The can may be stopped using a pair of stop members moved into a space between the pair of rails. After a selected number of cans are stopped against the stop members, a pair of push members may be moved into the space between the pair of rails behind the selected number of cans along the path between the rails. The stop members may be removed from the space between the pair of rails. The push members may move along the path between the rails to push the selected number of cans along the path between the rails. A can carrier may be positioned above the cans with a member. The can carrier may be attached to tops of the selected number of cans using a downward force on the can carrier provided by at least one roller as the cans are pushed past the member along the path between the rails.

In certain embodiments, an apparatus for coupling one or more can carriers to a plurality of cans includes rails for guiding movement of the cans through the apparatus and at least one push member used to push the cans through the apparatus between the rails. A member (e.g., hopper) may be positioned to provide at least one can carrier on top of the cans. At least one roller may be positioned to provide a downward force on a can carrier and attach said can carrier to one or more of the cans as said cans are pushed past the at least one roller by the at least one push member.

In certain embodiments, a method includes moving cans into a space between a pair of rails and pushing the cans in the space between the pair of rails towards a member and at least one roller using at least one push member. A can carrier may be positioned above a selected number of the cans with the member. The can carrier may be attached to tops of the selected number of cans using a downward force provided on the can carrier by the at least one roller as the selected number of cans are pushed, by the at least one push member, past the member and the at least one roller.

BRIEF DESCRIPTION OF THE DRAWINGS

Features and advantages of the methods and apparatus described herein will be more fully appreciated by reference to the following detailed description of presently preferred but nonetheless illustrative embodiments when taken in conjunction with the accompanying drawings in which.

Figure 1:
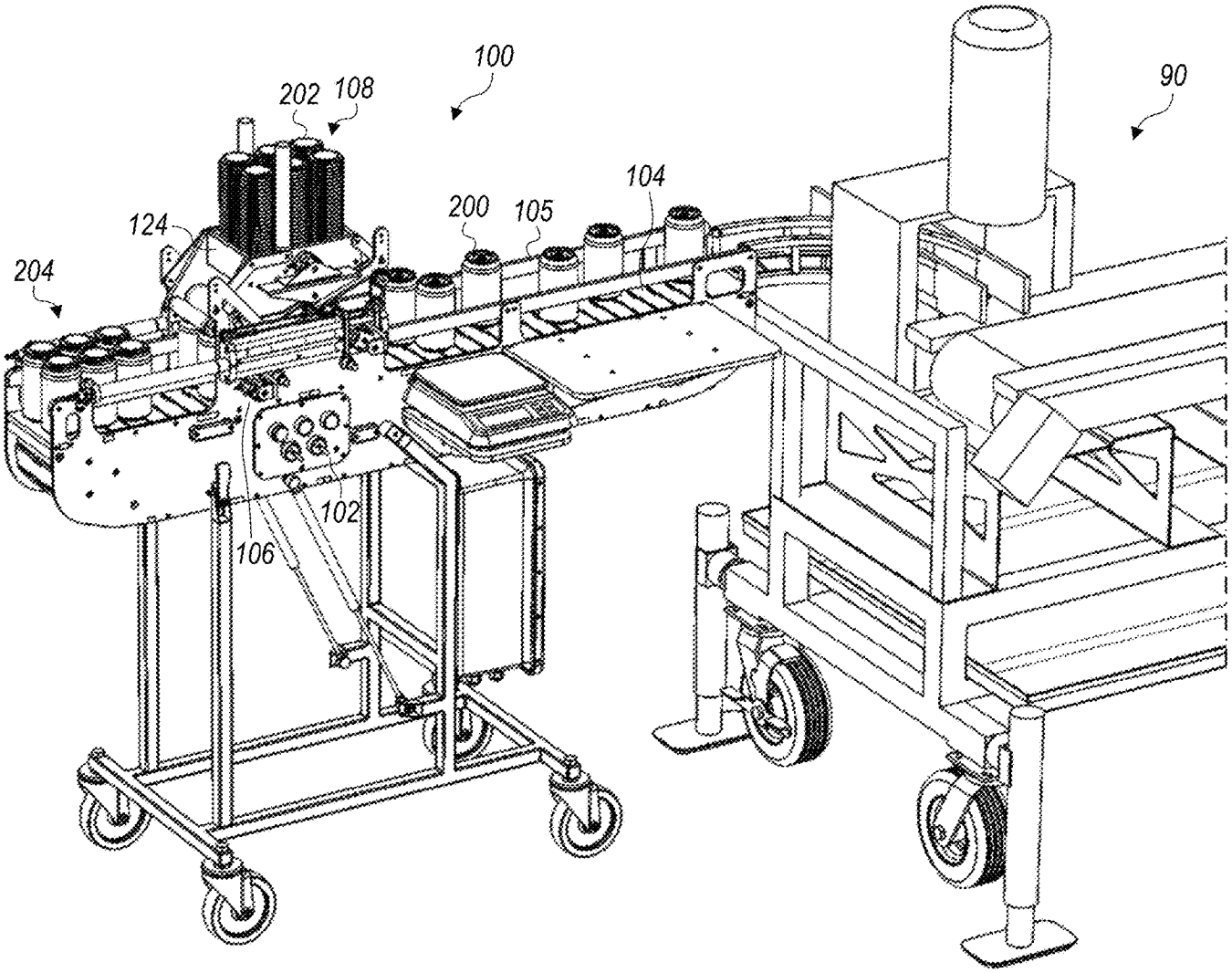
FIG. 1 depicts a perspective view of an embodiment of can carrier coupling apparatus.

While the disclosure is susceptible to various modifications and alternative forms, specific embodiments thereof are shown by way of example in the drawings and will herein be described in detail. It should be understood, however, that the drawings and detailed description thereto are not intended to limit the disclosure to the particular form illustrated, but on the contrary, the intention is to cover all modifications, equivalents and alternatives falling within the spirit and scope of the present disclosure as defined by the appended claims. The headings used herein are for organizational purposes only and are not meant to be used to limit the scope of the description. As used throughout this application, the word "may" is used in a permissive sense (i.e., meaning having the potential to), rather than the mandatory sense (i.e., meaning must). Similarly, the words "include," "including," and "includes" mean including, but not limited to. Additionally, as used in this specification and the appended claims, the singular forms "a", "an", and "the" include singular and plural referents unless the content clearly dictates otherwise. Furthermore, the word "may" is used throughout this application in a permissive sense (i.e., having the potential to, being able to), not in a mandatory sense (i.e., must). The term "include," and derivations thereof, mean "including, but not limited to." The term "coupled" means directly or indirectly connected.

The scope of the present disclosure includes any feature or combination of features disclosed herein (either explicitly or implicitly), or any generalization thereof, if it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

DETAILED DESCRIPTION OF EMBODIMENTS

The following examples are included to demonstrate preferred embodiments. It should be appreciated by those of skill in the art that the techniques disclosed in the examples which follow represent techniques discovered by the inventor to function well in the practice of the disclosed embodiments, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the disclosed embodiments.

This specification includes references to "one embodiment" or "an embodiment." The appearances of the phrases "in one embodiment" or "in an embodiment" do not necessarily refer to the same embodiment, although embodiments that include any combination of the features are generally contemplated, unless expressly disclaimed herein. Particular features, structures, or characteristics may be combined in any suitable manner consistent with this disclosure.

FIG. 1 depicts a perspective view of an embodiment of can carrier coupling apparatus 100. Apparatus 100 may be used to couple can carriers (described herein) to cans (e.g., aluminum cans). In certain embodiments, apparatus 100 is used to couple plastic can carriers such as PakTech® can carriers to cans to form multiple "packs" of cans. In certain embodiments, apparatus is used to couple plastic can carriers to form 6-packs of 12-oz. cans (e.g., 6 12-oz. cans are coupled to a 6-pack can carrier). Apparatus 100 may, however, be designed or adjusted to operate with plastic can carriers of varying sizes. For example, apparatus 100 may be adjusted to operate with plastic can carriers for 4-packs ("quad packs) or 8-packs of cans. Additionally, apparatus 100 may be designed or adjusted to operate with cans of different sizes. For example, apparatus 100 may be adjusted to operate with 16-oz. cans or 24-oz. cans. Adjustment of apparatus 100 to accommodate different sizes of plastic can carriers and/or different sizes of cans may be accomplished with adjustable settings (e.g., height adjustments) on the apparatus.

In certain embodiments, apparatus 100 includes controller 102, conveyor 104, can shuttle device 106, and can carrier dispenser 108. Controller 102 may be used to control operations of apparatus 100 and operate the apparatus to couple can carriers to cans as the cans move through the apparatus. For example, controller 102 may control operation of conveyor 104 in addition to operation of valves, motors, and other devices in apparatus 100 such as, but not limited to, valves and motors associated with can shuttle device 106 and can carrier dispenser 108 described herein. In some embodiments, controller 102 includes start/stop controls along with speed controls and/or other adjustment controls.

Conveyor 104 may be, for example, a conveyor belt or other motor driven conveyor that moves cans along a relatively flat surface through apparatus 100. Rails 105 may be used to provide guides or walls on conveyor 104 to prevent cans from falling off the side of the conveyor. In certain embodiments, conveyor 102 has a width between rails 105 to accommodate two cans (e.g., two 12-oz. cans) side-by-side on the conveyor. The width of conveyor may vary, however, depending on, for example, a width of can carriers (e.g., the number of cans accommodated by the width of the can carriers) and/or the width of the cans. In some embodiments, conveyor 104 and apparatus 100 are coupled to can filling apparatus 90. Can filling apparatus 90 may be, for example, an apparatus for filling cans with liquid (e.g., water, juice, beer, and/or soda).

In certain embodiments, can shuttle device 106 includes one or more mechanisms for controlling movement of cans through apparatus 100 independently of conveyor 104. For example, can shuttle device 106 may slow down the speed of cans moving through apparatus 100, stop the movement of cans through the apparatus, and/or increase the speed of cans moving through the apparatus where the speed is slowed, stopped, or increased independently of the movement of conveyor 104.

Figure 2:
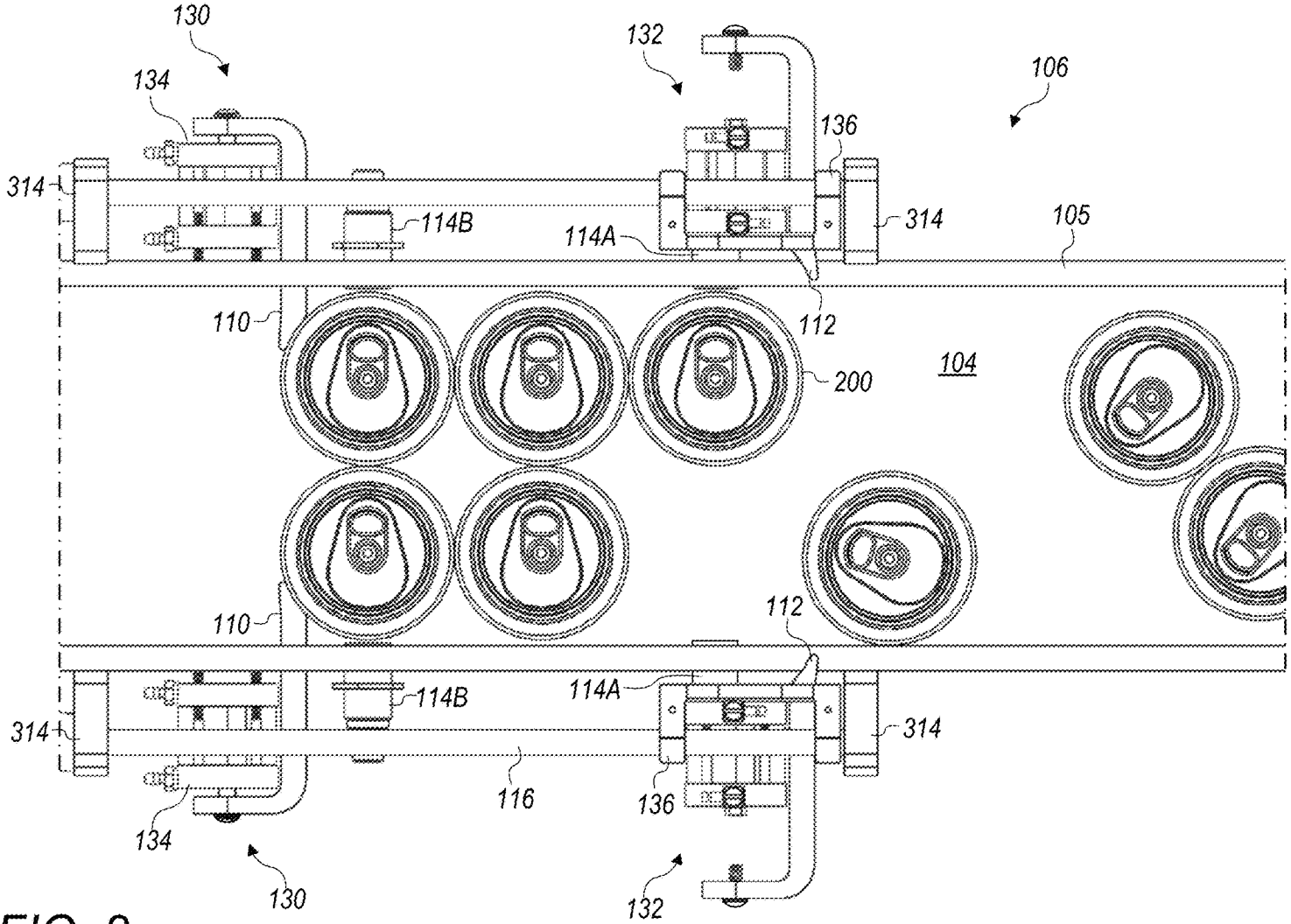
FIG. 2 depicts a top view representation of an embodiment of a can shuttle device as cans move into the can shuttle device along a conveyor.

FIG. 2 depicts a top view representation of an embodiment of can shuttle device 106 as cans 200 move into the can shuttle device along conveyor 104. It should be noted that, as depicted in the top view representations in the figures, conveyor 104 and cans 200 are moving in a right to left direction. In certain embodiments, can shuttle device 106 includes stops 130, pushers 132, and sensors 114. Stops 130 may include stop bodies 134 and stop members 110. Pushers 132 may include push bodies 136 and push members 112. Stop members 110 and push members 112 may be members (e.g., stop fingers and push fingers) that move in and out of the space between rails 105 (e.g., in and out of the path of movement of cans 200 along conveyor 104). In certain embodiments, stop members 110 and/or push members 112 have end shapes (e.g., finger shapes) that conform to the shapes of cans 200. The conformal shapes of stop members 110 and/or push members 112 may assist in holding cans 200 in proper position as the cans move through can shuttle device 106.

Figure 6:
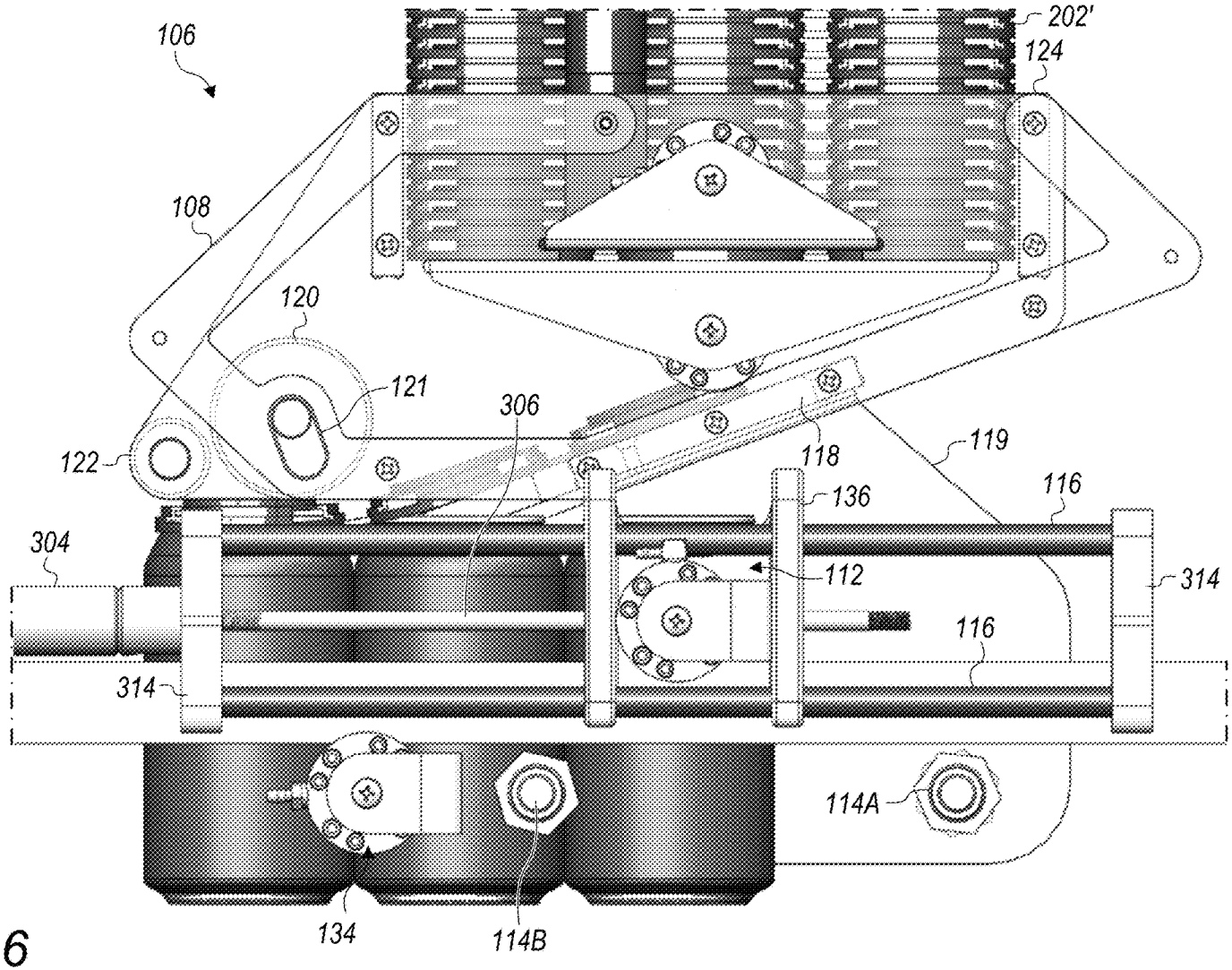
FIG. 6 depicts a side view representation of an embodiment of a can shuttle device with cans being pushed by push members and a can carrier being attached to the cans.

In certain embodiments, stop members 110 and/or push members 112 are pneumatically controlled members (e.g., the in and out movement of the members is pneumatically controlled). Stop members 110 and/or push members 112 may, however, be operated by other means such as, but not limited to, mechanically or electrically. As shown in FIG. 2, stop members 110 may be inserted into the space between rails 105 (e.g., in the "can stopping" position) and cans 200 are prevented from moving beyond the stop members while push members 112 are retracted from the space between the rails to allow the cans to move into can shuttle device 106. As cans 200 move into can shuttle device 106, the cans may push up against stop members 110 and each other and align in 2 rows (e.g., the configuration of a pack of cans). In some embodiments, stop members 110 are positioned to contact cans 200 along a lower portion of the cans (for example, as shown in FIG. 6, which is described below). Additionally, push members 112 may be positioned to contact cans 200 along an upper portion of the cans (also shown in FIG. 6). Stop members 110 and push members 112 may be positioned to contact cans 200 along different portions to allow the stop members and push members to overlap during operation of apparatus 100 (e.g., the push members may push the cans past the stop members as described herein).

In certain embodiments, as cans 200 move into can shuttle device 106, sensors 114 may be used to assess a number and/or positions of cans inside the can shuttle device. Sensors 114 may be, for example, inductive proximity sensors to detect the presence of metal cans (e.g., cans 200). In certain embodiments, sensors 114A are positioned at or near the entrance of cans 200 into can shuttle device 106 (e.g., near push members 112) and sensors 114B are positioned at or near the exit of the can shuttle device (e.g., near stop members 110). In one embodiment, sensors 114A are used to determine when 6 cans have entered the can shuttle device 106. For example, in some embodiments, sensors 114A may be used to count the number of cans entering can shuttle device 106 until the selected number of cans on each side have entered the can shuttle device (e.g., the number of cans needed for a can carrier). In some embodiments, sensors 114A may be used to detect when cans are stationary in front of the sensors (which occurs once the selected number of cans are on each side of conveyor 104 inside can shuttle device 106).

Figure 3:
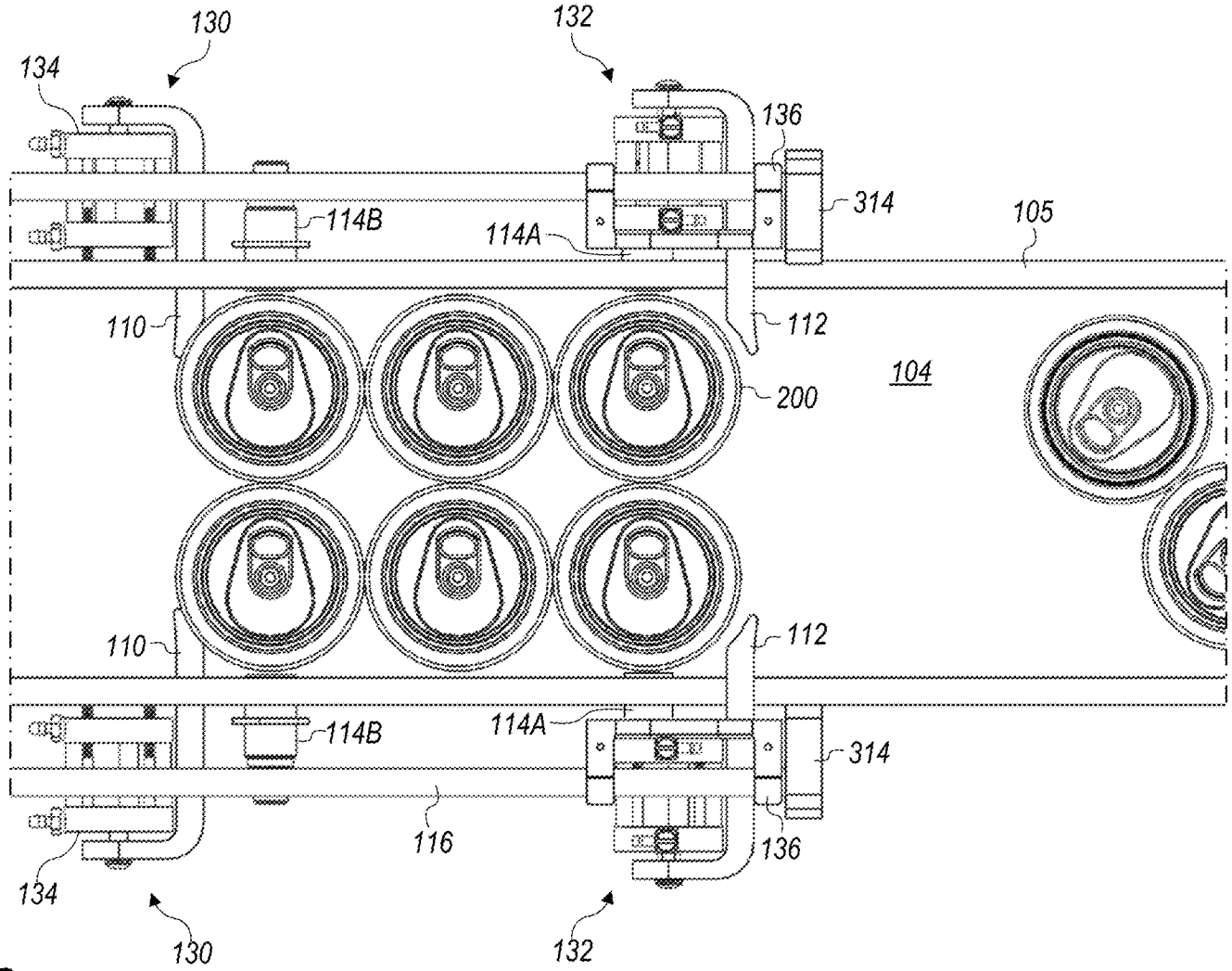
FIG. 3 depicts a top view representation of an embodiment of a can shuttle device as six cans are positioned between stop members and push members.

After the selected number of cans 200 (e.g., six cans), as determined by sensors 114, are positioned inside of can shuttle device 106, push members 112 may be inserted into the space between rails 105 (e.g., inserted in the can shuttle device). FIG. 3 depicts a top view representation of an embodiment of can shuttle device 106 as six cans 200 are positioned between stop members 110 and push members 112. In some embodiments, conveyor 104 is stopped when push members 112 are inserted between rails 105 in can shuttle device 106. Stopping conveyor 104 may prevent additional cans from pushing against push members 112 and/or prevent cans from entering can shuttle device 106 while the push members are used to move cans through the can shuttle device (e.g., along a path of conveyor 104).

Figure 4:
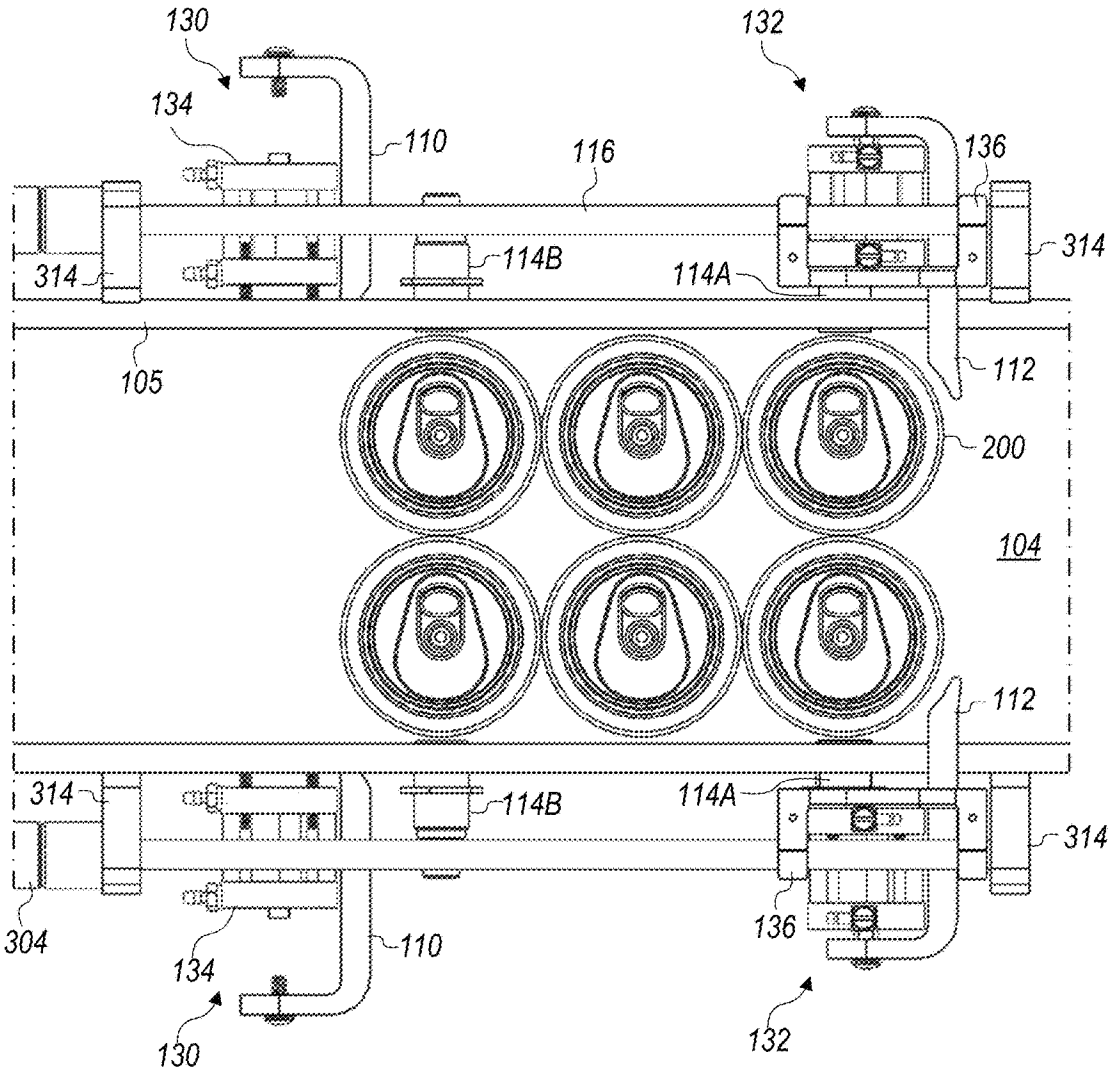
FIG. 4 depicts a top view representation of an embodiment of a can shuttle device with stop members retracted.

In certain embodiments, once push members 112 are inserted, stop members 110 may be retracted (e.g., moved out of the space between rails 105), as shown in FIG. 4. Once stop members 110 are retracted, push members 112 may push cans 200 through can shuttle device 106 (e.g., along the path of conveyor 104). In certain embodiments, push members 112 are coupled to push bodies 136. Push bodies 136 may move along rails 116 in can shuttle device 106. Thus, as push bodies 136 and push members 112 are moved along rails 116 (e.g., by pneumatic pistons described herein), the push members may move cans through can shuttle device 106 along the path of conveyor 104.

Figure 5:
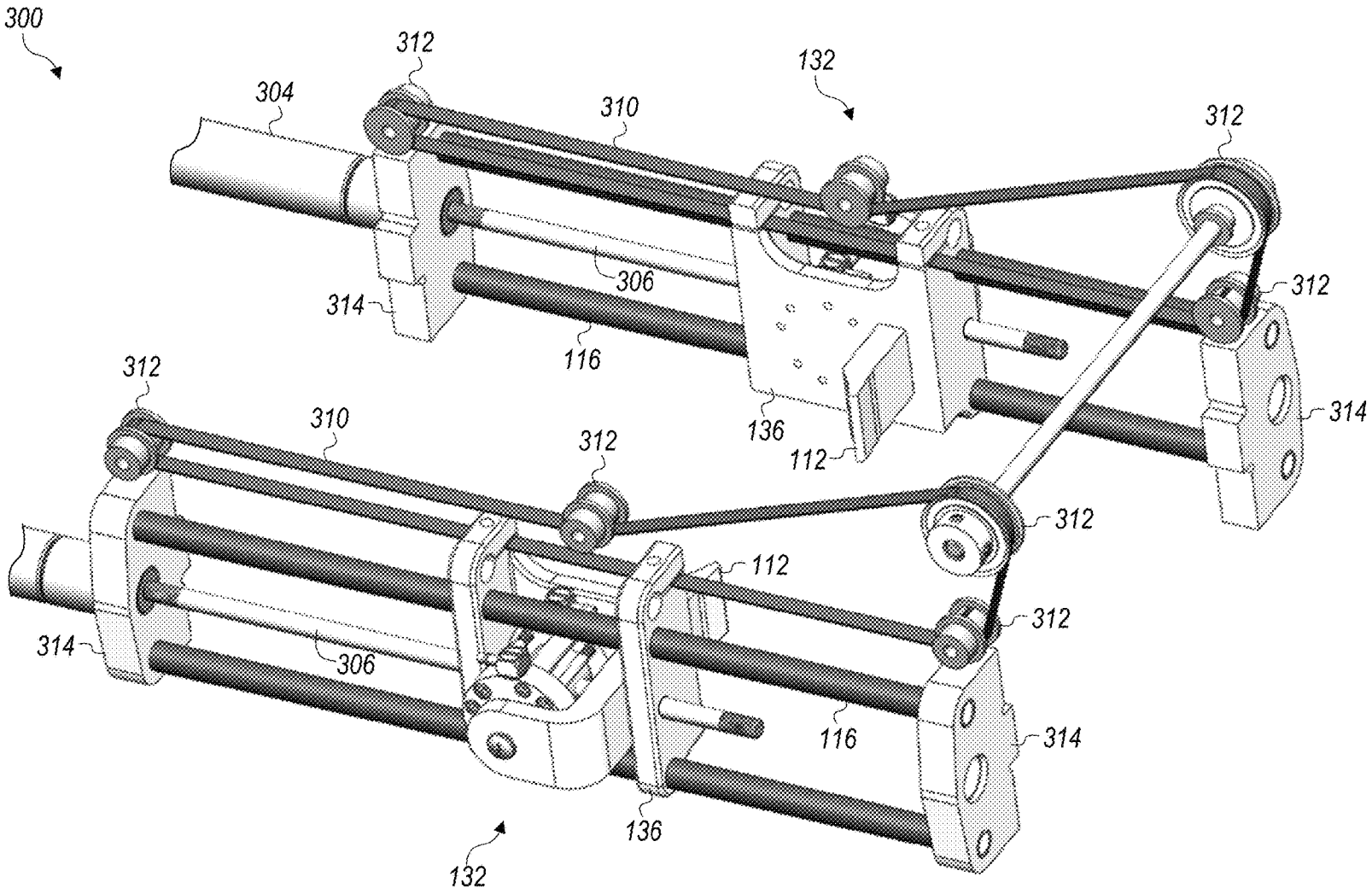
FIG. 5 depicts a perspective view of an embodiment of a push member drive system.

FIG. 5 depicts a perspective view of an embodiment of push member drive system 300. Drive system 300 may be used to move push members 112 within can shuttle device 106 (e.g., move the push members from one end of the can shuttle device to the other). As shown in FIG. 5, push members 112 may be coupled to push bodies 136. Push bodies 136 may include operating mechanisms for inserting and retracting push members 112 (e.g., pneumatics for operation of the push members). Push bodies 136 may be placed on rails 116. Rails 116 may be rails or guides for controlling movement of push bodies 136. Rail ends 314 may hold rails 116 and be coupled to rails 105 (or another part of the body of apparatus 100).

In certain embodiments, push bodies 136 are attached to pistons 304 using rods 306. Rods 306 may be, for example, threaded rods or another fixable coupling between push bodies 136 and pistons 304. In certain embodiments, pistons 304 are pneumatically operated pistons. Pistons 304 may be operated, for example, using pneumatical valves attached to the pistons. Pistons 304 may, however, be operated by other means such as, but not limited to, mechanically or electrically. Operation of pistons 304 may be controlled by controller 102.

In certain embodiments, pulley system 308 is attached to push bodies 136. Pulley system 308 may include belts 310 and one or more pulleys 312 on each side of drive system 300. Each push body 136 may be attached a set of belts 310 and pulleys 312 on its respective side of drive system 300. The opposite side sets of belts 310 and pulleys 312 may be coupled using rod 314. Coupling the opposite side sets of belts 310 and pulleys 312 with rod 314 may synchronize movement of push bodies 136 on the opposite sides. Synchronizing the movement of push bodies 136 may balance operation of push members 112 and provide smooth movement of cans 200 through can shuttle device 106.

Figure 7:
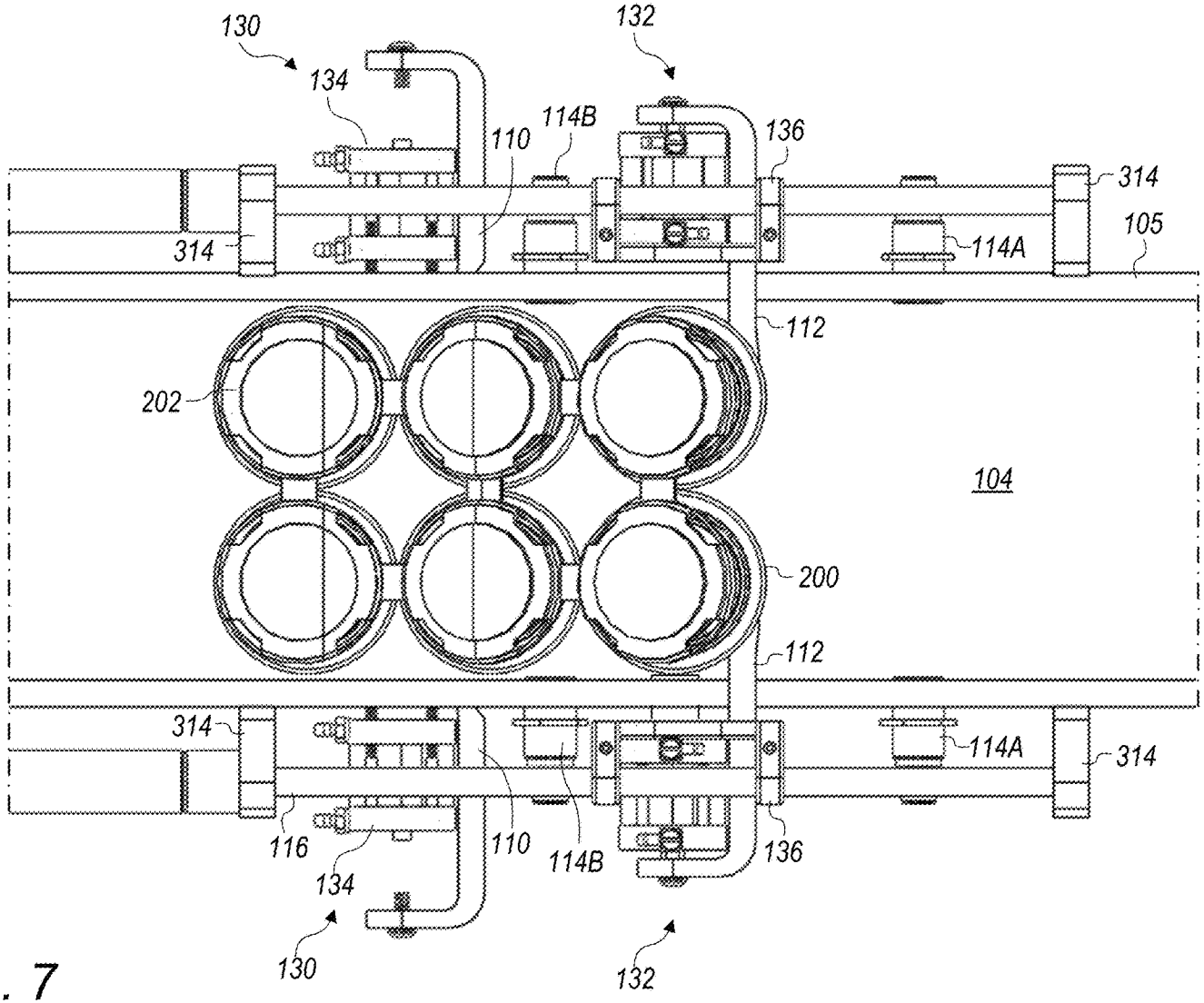
FIG. 7 depicts a top view representation of the embodiment depicted in FIG. 6.

After stop members 110 are retracted (as shown in FIG. 4), push members 112 may begin to move (e.g., push) cans 200 through can shuttle device 106 along the path of conveyor 104, as shown in FIGS. 6 and 7. FIG. 6 depicts a side view representation of an embodiment of can shuttle device 106 with cans 200 being pushed by push members 112 and can carrier 202 being attached to the cans. FIG. 6 also depicts can carrier dispenser 108 coupled to can shuttle device 106. In some embodiments, can carrier dispenser 108 and can shuttle device 106 are separate pieces attached together to form apparatus 100. In some embodiments, can carrier dispenser 108 and can shuttle device 106 are formed as a single apparatus. FIG. 7 depicts a top view representation of the embodiment depicted in FIG. 6 with can carrier dispenser 108 not shown for clarity. As shown in FIG. 7, push members 112 continue to move cans 200 through can shuttle device 106 as can carrier 202 is being attached to the cans.

As shown in FIG. 6, can carrier dispenser 108 may be used to couple can carrier 202 to cans 200 as the cans are moved through can shuttle device 106 by push members 112. In certain embodiments, can carrier dispenser 108 includes hopper 118, first roller 120, and second roller 122. Hopper 118 may be a member (e.g., a holding or positioning member) used to hold and align can carrier 202 with cans 200. As cans 200 are pushed past hopper 118, the cans may engage can carrier 202. As cans 200 and can carrier 202 engage, the can carrier may be coupled to (e.g., attached to or snapped in place on) the cans using first roller 120 and/or second roller 122. In certain embodiments, divider 119 is attached to hopper 118. Divider 119 may be a thin walled divider positioned along a center line of hopper 118 (and thus a center line of can carrier 202). Divider 119 may extend into the space between cans 200 (as shown in FIG. 6, the divider may extend near the bottom portion of the cans). Divider 119 (along with rails 105) may align cans 200 underneath can carrier 202 such that the cans are properly attached to the can carrier.

In certain embodiments, the ends of first roller 120 are positioned in slots 121. Slots 121 may allow up/down movement of first roller 120 with a predetermined amount of tilt to the movement. Gravity force may cause downward movement of first roller 120 in slots 121 (e.g., the weight of the roller moves the roller downwards in the slots when there is no upward pushing force). Upward movement of first roller 120 may be caused by the upwards pushing movement from cans 200 as the cans move past the first roller. The upward force applied by cans 200 may be stronger than the downward gravity force on first roller 120. Thus, first roller 120 may move upwards in slots 121 as cans 200 contact and move under the roller. For example, as shown in FIG. 6, first roller 120 is moved to the top of the slot as can 200 pushes up on can carrier 202 and the roller. First roller 120 may, however, apply downward pressure to the top of can carrier 202 and can 200 when the first roller reaches the top of slots 121 (e.g., when the roller cannot move any higher). In certain embodiments, first roller 120 has a diameter sized to apply downward force to can carrier 202 and cans 200 when the first roller is at the top of slots 121.

Figure 15:
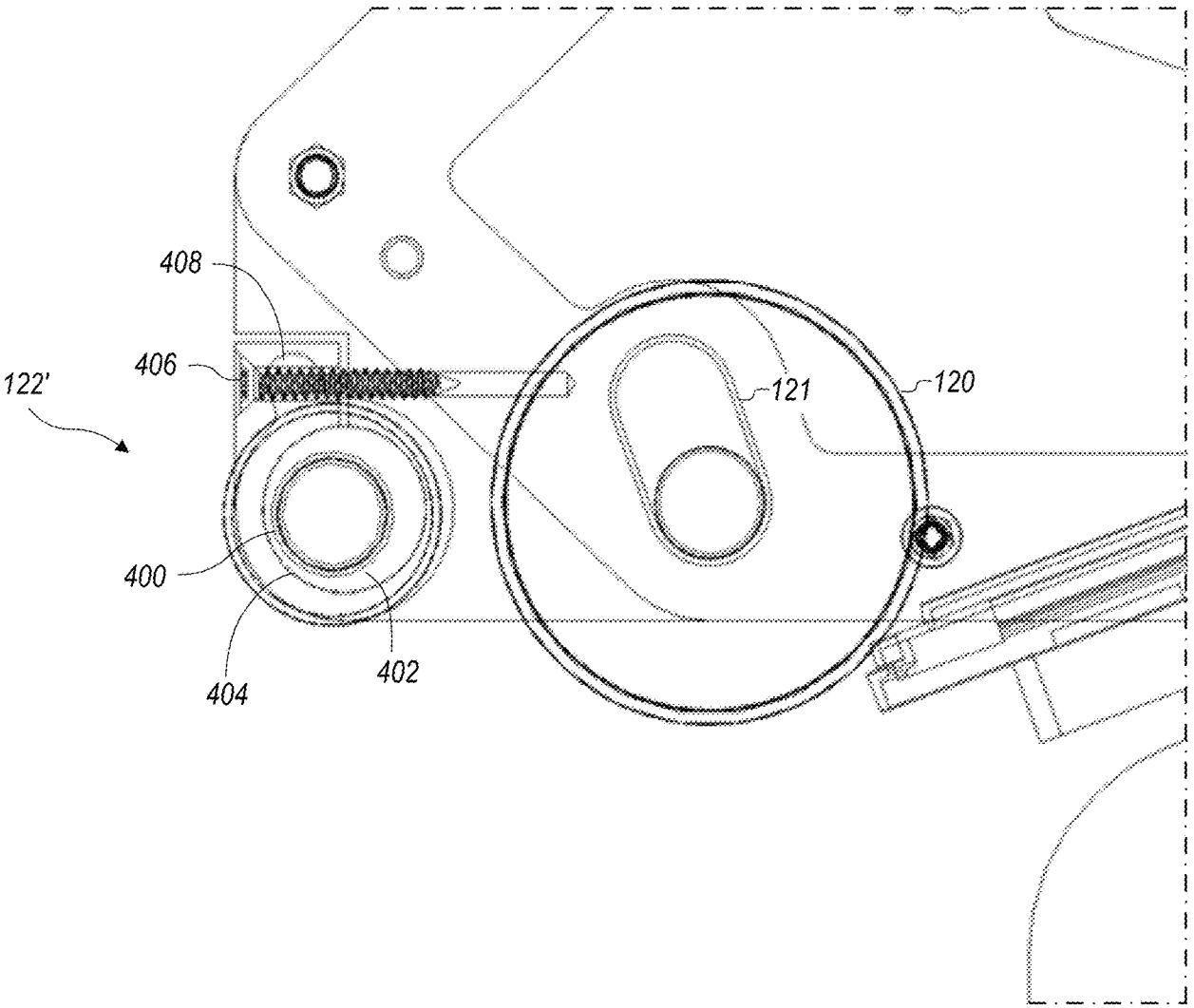
FIG. 15 depicts an enlarged side-view representation of an embodiment of a first roller and an adjustable second roller.

In certain embodiments, second roller 122 is a fixed position roller, as shown in FIG. 6. In some embodiments, second roller 122 is an adjustable position roller (e.g., the position of the second roller is adjustable). FIG. 15 depicts an enlarged side-view representation of an embodiment of first roller 120 and adjustable second roller 122'. Adjustable second roller 122' may be used instead of fixed position second roller 122 (shown in FIG. 6). As shown in FIG. 15, adjustable second roller 122' may include roller bore 400 surrounded by eccentric roller bushing 402. Eccentric roller bushing 402 may be located in bushing bore 404. Bushing clamp screw 406 may be used to adjust the position of eccentric roller bushing 402 through bushing adjustment tab 408. Bushing clamp screw 406 may be used to adjust the vertical position of roller 122 (e.g., rotation of the screw may adjust the vertical position of roller 122). Roller 122 may be fixed in position at the vertical position set by rotation of bushing clamp screw 406. Thus, roller 122 may be adjusted vertically but set in a fixed position to provide downward force as described herein. Allowing some adjustment of the vertical position of roller 122 (via bushing clamp screw 406) may provide accommodation for slight variations in heights of cans 200.

Figure 8:
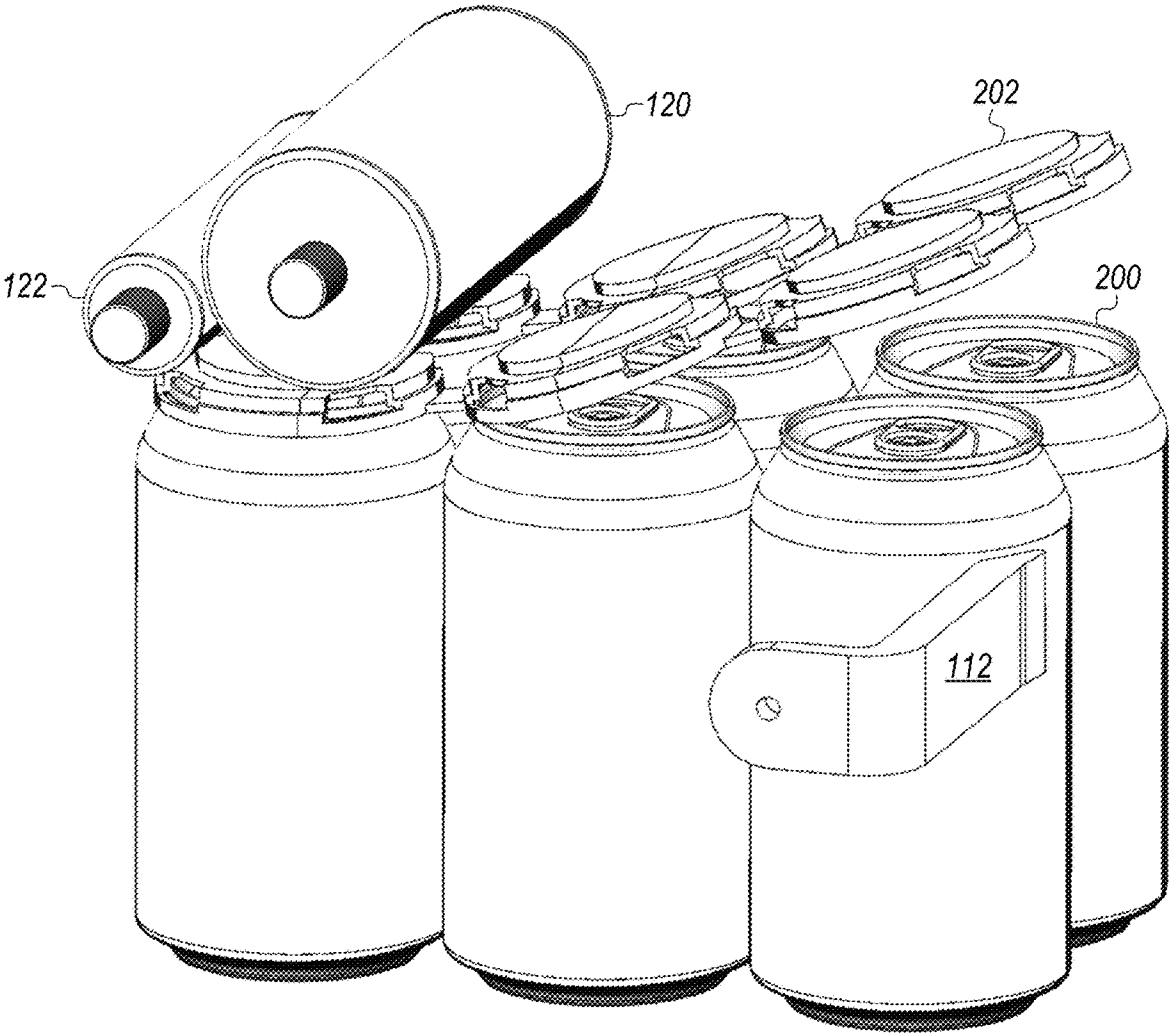
FIG. 8 depicts an isolated view representation of cans with a can carrier being attached to the cans.

First roller 120 and/or second roller 122 may, individually or in combination, apply downward pressure (e.g., downward force) on can carrier 202 to couple the can carrier to cans 200 (e.g., attach or snap the can carrier into place on the top of the cans). FIG. 8 depicts an isolated view representation of cans 200 with can carrier 202 being attached to the cans using first roller 120 and second roller 122 while push members 112 move the cans. In certain embodiments, second roller 122 has a smaller diameter than first roller 120 and the second roller is positioned a predetermined distance from the first roller. The diameters and weights of first roller 120 and/or second roller 122 may be designed in combination with the predetermined distance between the rollers and the angle and size of slots 121 to provide selected properties for attaching can carriers 202 to cans 200. For example, first roller 120 and/or second roller 120 may be designed to apply sufficient downward force to can carrier 202 and cans 200 to attach the can carrier to the cans while preventing the cans from being moved or tilted out of place (e.g., prevent the cans from tipping over as the can carrier is attached and the cans move past the rollers).

Figure 9:
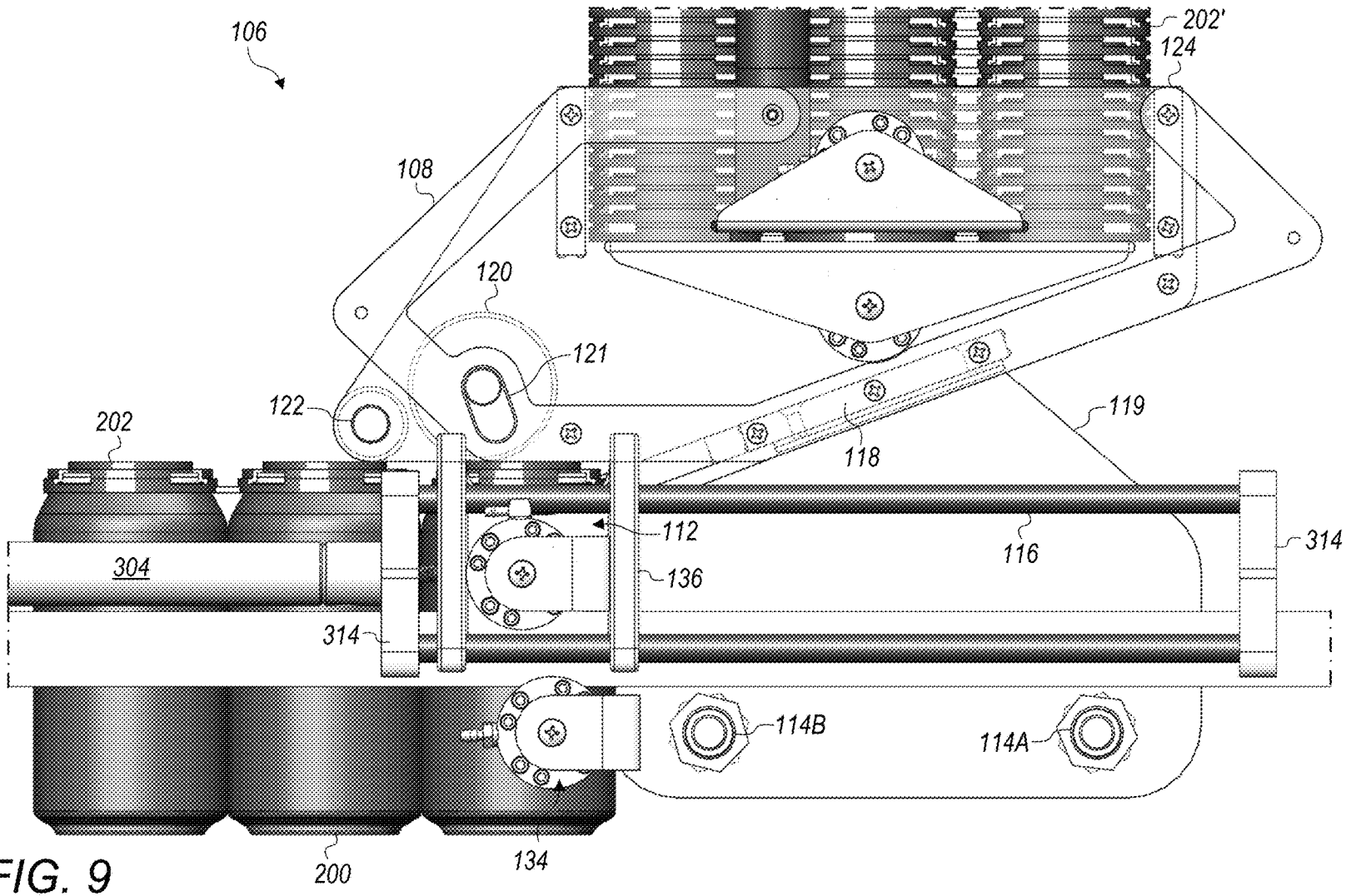
FIG. 9 depicts a side view representation of an embodiment of a can shuttle device with cans being pushed by push members after a can carrier has been attached to the cans.
Figure 10:
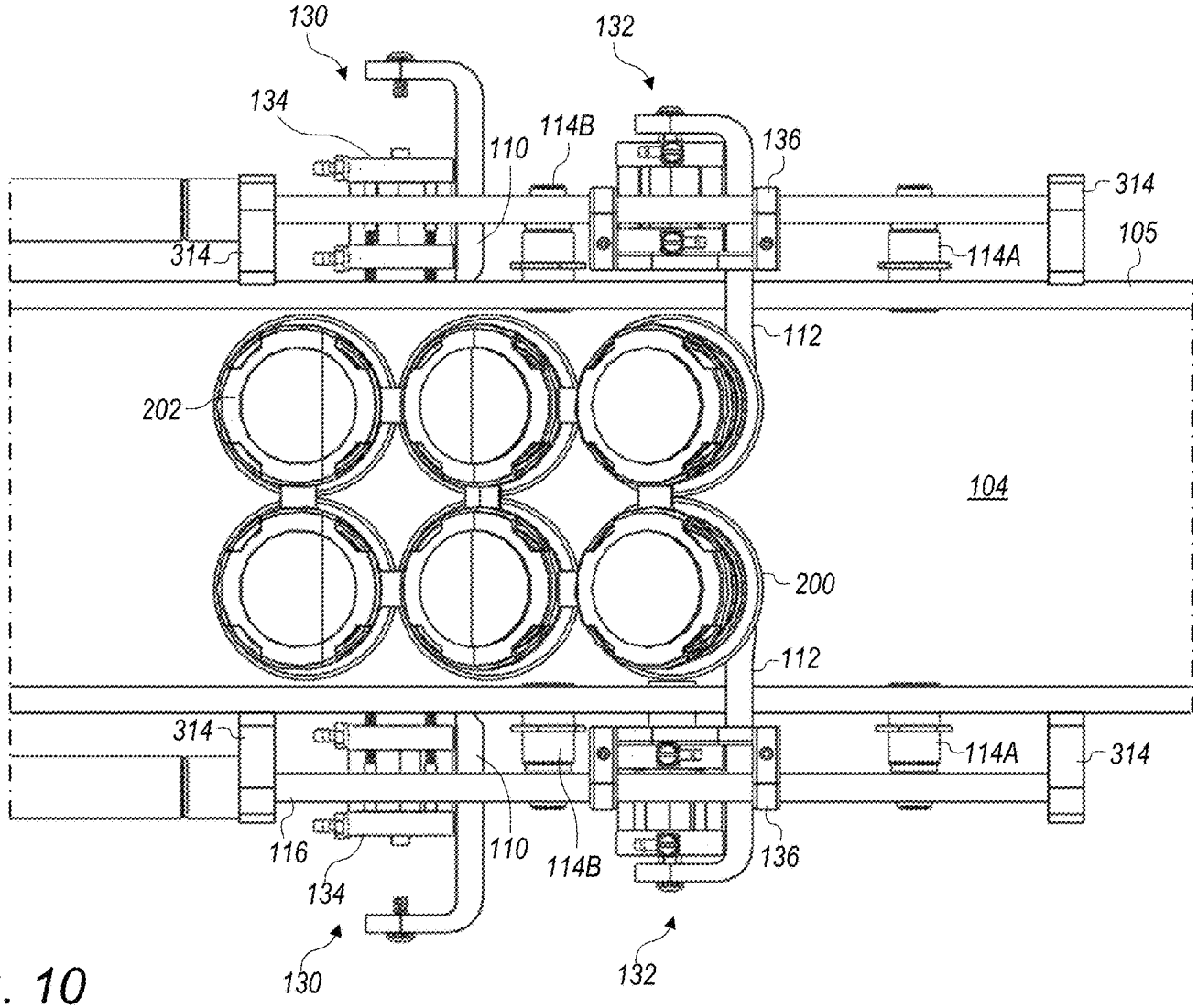
FIG. 10 depicts a top view representation of the embodiment of FIG. 9.

FIG. 9 depicts a side view representation of an embodiment of can shuttle device 106 with cans 200 being pushed by push members 112 after can carrier 202 has been attached to the cans. FIG. 10 depicts a top view representation of the embodiment of FIG. 9. As shown in FIGS. 9 and 10, as the last cans 200 move past first roller 120, can carrier 202 is attached to the top of each of the cans in the pack of cans (e.g., each of the 6 cans in the six-pack of cans). Additionally, once push members 112 are at the end of their movement (e.g., the far leftward movement against rail end 314 as depicted), the conveyor may move cans 200, with attached can carrier 202, out of can shuttle device 106. After cans 200, with can carrier 202 attached, are moved out of can shuttle device 106, push members 112 may retract and push bodies 136 may move the push members back to their default position (e.g., the position of the push members depicted in FIG. 2). In addition, stop members 110 may be inserted into the "can stopping" position (or default position with the stop members inserted in space between rails 105) to provide a stop for the next set of cans to enter can shuttle device 106 (e.g., the position of the stop members depicted in FIG. 2). Once stop members 110 and push members 112 are reset to their "default" positions, additional cans 200 may enter can shuttle device 106 and the process may be repeated to attach another can carrier to the cans.

Figure 16:
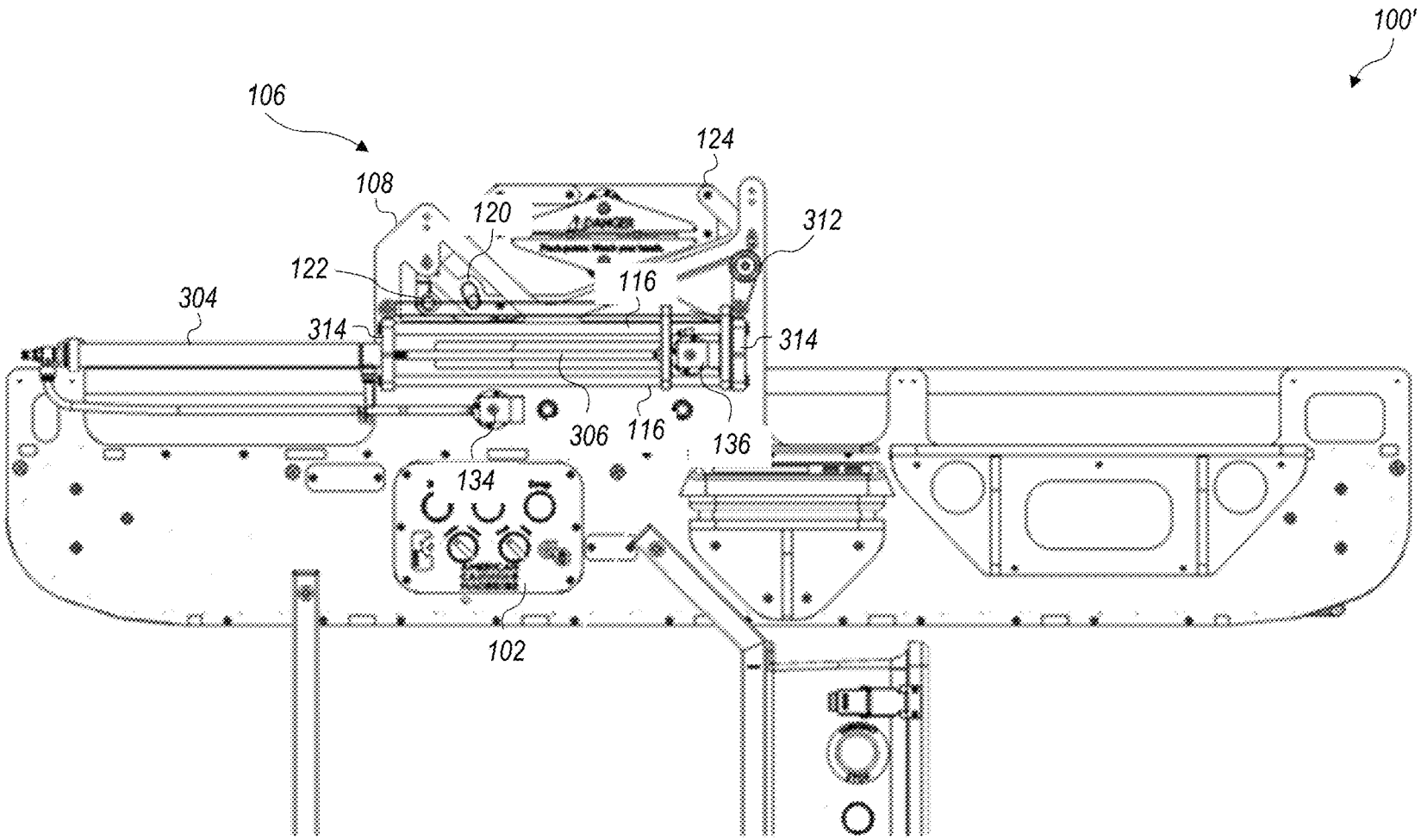
FIG. 16 depicts a side-view representation of an alternative embodiment of a can carrier coupling apparatus.

In certain embodiments, as shown in FIG. 9, the end of the movement of push members 112 is underneath first roller 120 and second roller 122. For example, rail end 314 is positioned under first roller 120 and second roller 122 where the far leftward movement (as depicted) of push members 112 is limited by the left (as depicted) rail end 314. In some embodiments, rail end 314 may, however, have other positions relative to first roller 120 and second roller 122. For example, FIG. 16 depicts a side-view representation of an alternative embodiment of can carrier coupling apparatus 100' with rail end 314 positioned leftwards of first roller 120 and second roller 122. Positioning rail end 314 past first roller 120 and second roller 122 (in relation to the path of cans 200 through the apparatus 100') may allow push members 112 (attached to push bodies 136) to move the cans beyond the position of the first roller and the second roller.

Figure 11:
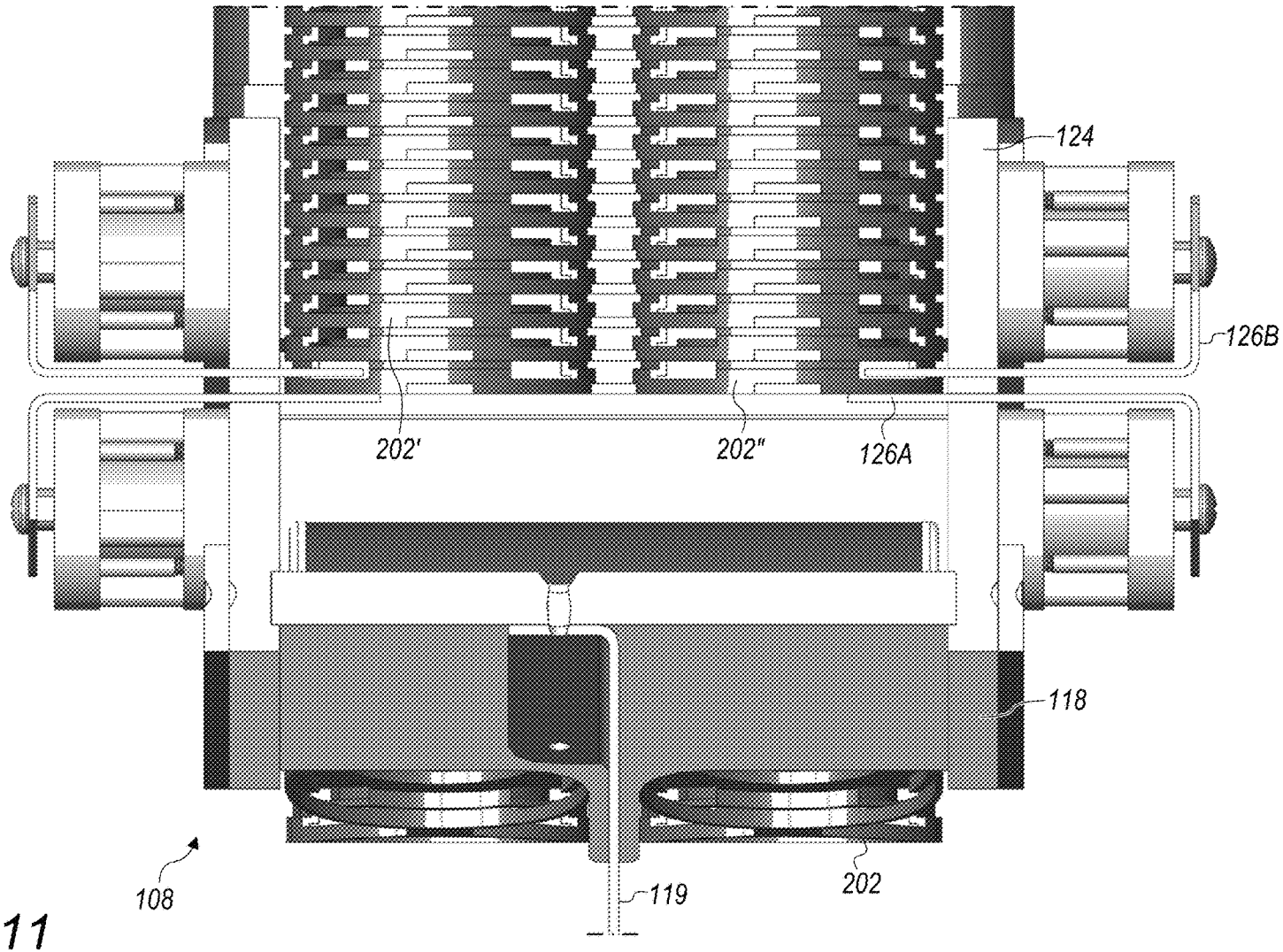
FIG. 11 depicts a front view representation of an embodiment of a can carrier dispenser as a can carrier is exiting a hopper.

FIGS. 11-14 depict front views of various stages of can carrier 202 being provided from can carrier dispenser 108 (and onto cans 200). FIG. 11 depicts a front view representation of an embodiment of can carrier dispenser 108 as can carrier 202 is exiting hopper 118 (e.g., the can carrier dispenser and the can carrier are in similar positions to the positions depicted in FIG. 6). As shown in FIG. 11, additional can carriers 202' are positioned in can holder 124 (e.g., the additional can carriers are "queued up" in the can holder). In certain embodiments, the next can carrier to be used (e.g., can carrier 202") is positioned between knives 126A, 126B. Knives 126A, 126B may be, for example, thin blades or other thin structures that are able to provide separation between can carriers. In certain embodiments, knives 126A, 126B are pneumatically operated to move in and out of the space between can carriers 202', 202". Knives 126A, 126B may also be operated, for example, mechanically or electrically.

Figure 12:
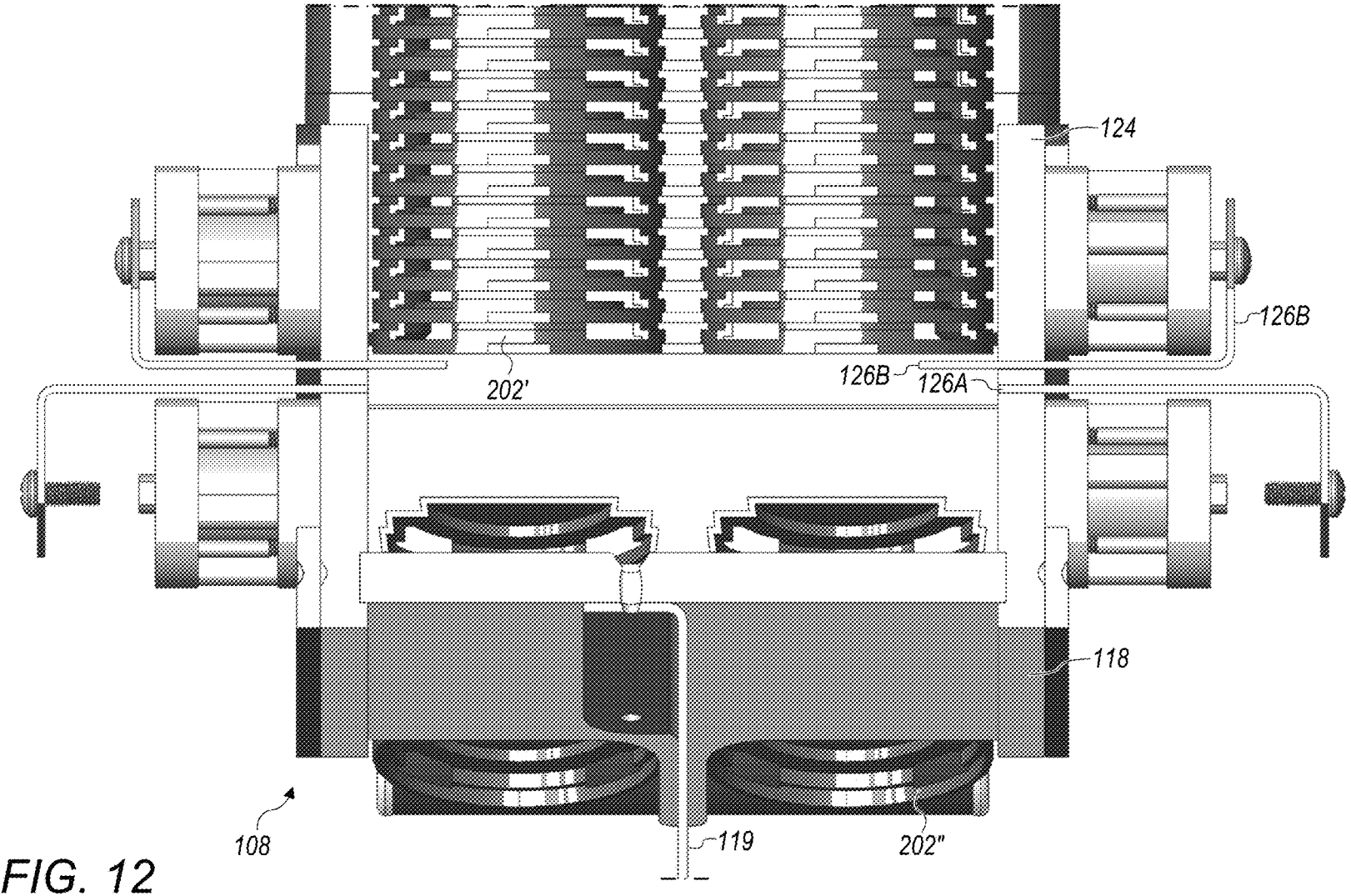
FIG. 12 depicts a front view representation of an embodiment of a can carrier dispenser after a can carrier has been attached to cans.

FIG. 12 depicts a front view representation of an embodiment of can carrier dispenser 108 after can carrier 202 (depicted in FIG. 11) has been attached to cans and moved out of hopper 118. Once can carrier 202 (depicted in FIG. 11) is moved out of hopper 118, first knife 126A may be retracted to allow can carrier 202" to drop into the hopper, as shown in FIG. 12. Second knife 126B, however, remains inserted to keep additional can carriers 202' from falling into hopper 118.

Figure 13:
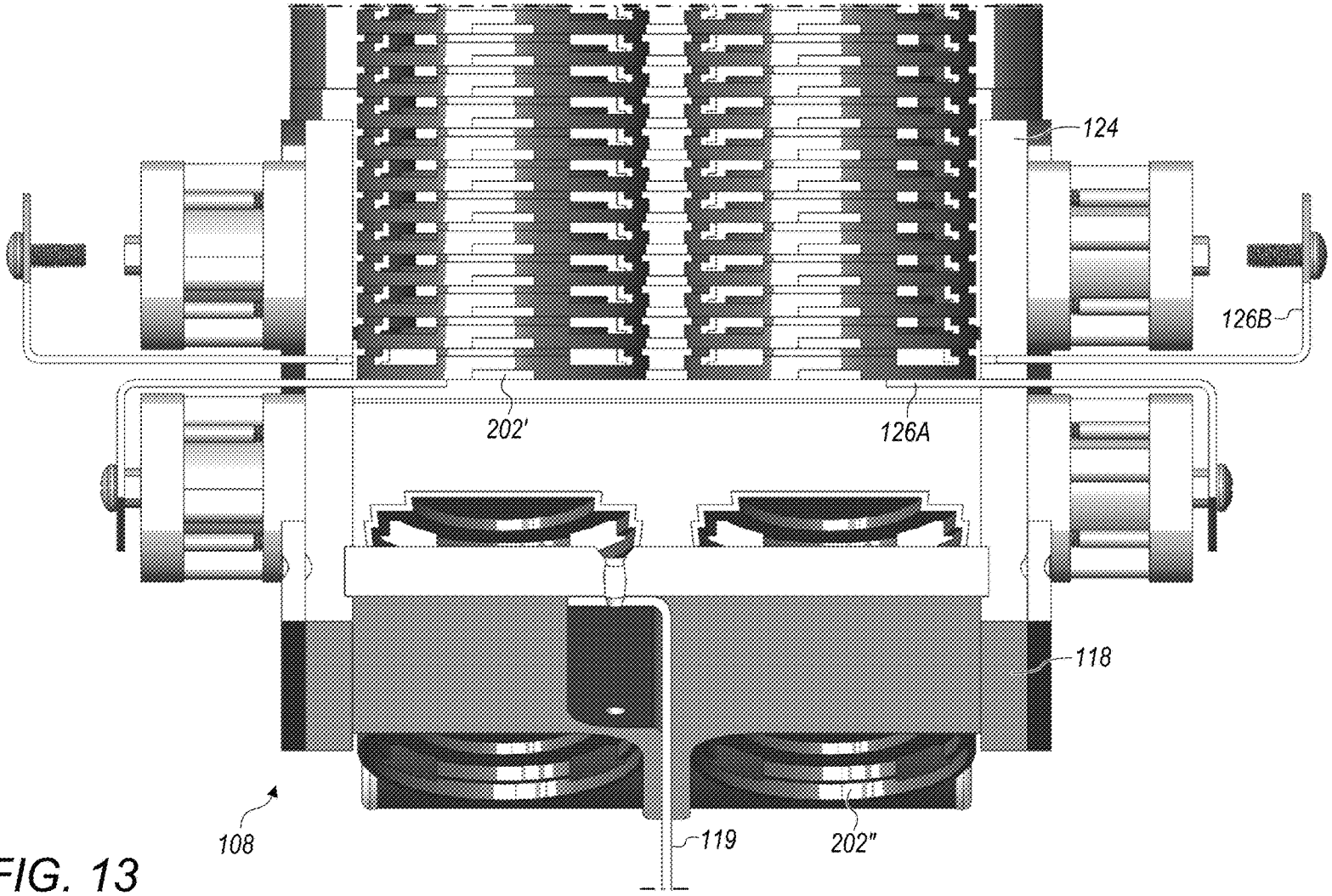
FIG. 13 depicts a front view representation of an embodiment of a can carrier dispenser with a second knife retracted.
Figure 14:
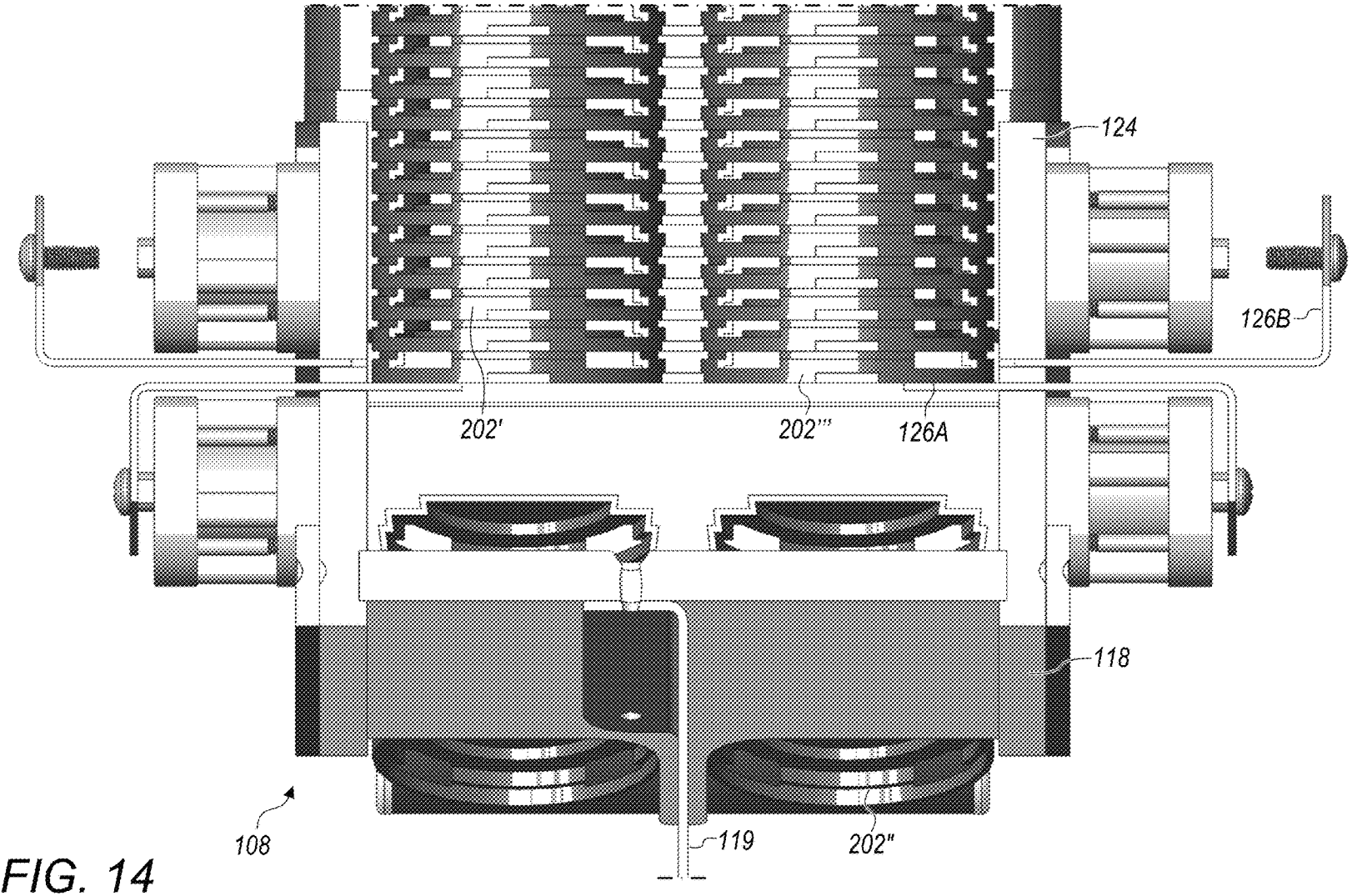
FIG. 14 depicts a front view representation of an embodiment of a can carrier dispenser with another can carrier positioned in the hopper.

After can carrier 202" drops into hopper 118, first knife 126A may be reinserted and second knife 126B may be retracted to allow additional can carriers 202' to fall and rest on the first knife, as shown in FIG. 13. After the stack of additional can carriers 202' falls and rests on first knife 126A, second knife 126B may be reinserted to separate can carrier 202'" from the stack of additional can carriers 202', as shown in FIG. 14. In the positions of can carriers 202 depicted in FIG. 14, can carrier 202" waits in hopper 118 to be attached to cans passing through can shuttle device 106 while can carrier 202'" waits to be dropped into the hopper after can carrier 202" moves out of the hopper. Using first knife 126A and second knife 126B to control the movement of can carriers 202 through can dispenser 108 and allow only one can carrier at a time to be positioned in hopper 118, as shown in FIGS. 11-14, may prevent additional weight from the stack of can carriers from interfering with the process for attaching the can carriers to the cans.

As described herein, can carrier coupling apparatus 100 provides a simple and inexpensive apparatus for attaching can carriers to sets of cans (e.g., six-packs of cans). For example, as shown in FIG. 1, apparatus 100 provides a simple, inexpensive, and efficient apparatus for receiving cans arriving individually from can filling apparatus 90 (to the right of can shuttle device 106 and can dispenser 108) and attaching a can carrier to a set of the cans (e.g., "six-pack 204" to the left of can shuttle device 106 and can dispenser 108). In some embodiments, apparatus may be capable of attaching can carriers to at least about 180 cans per minute of continuous operation (e.g., providing at least 30 six-packs per minute). Additionally, apparatus 100 provides an apparatus for attaching can carriers to cans that requires little to no manual operation. Thus, apparatus 100 may reduce manpower requirements for attaching can carriers to cans compared to manual methods (e.g., hammering can carriers onto cans).

Although specific embodiments have been described above, these embodiments are not intended to limit the scope of the present disclosure, even where only a single embodiment is described with respect to a particular feature. Examples of features provided in the disclosure are intended to be illustrative rather than restrictive unless stated otherwise. The above description is intended to cover such alternatives, modifications, and equivalents as would be apparent to a person skilled in the art having the benefit of this disclosure.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

Further modifications and alternative embodiments of various aspects of the embodiments described in this disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described herein are to be taken as the presently preferred embodiments. Elements and materials may be substituted for those illustrated and described herein, parts and processes may be reversed, and certain features of the embodiments may be utilized independently, all as would be apparent to one skilled in the art after having the benefit of this description. Changes may be made in the elements described herein without departing from the spirit and scope of the following claims.

What is claimed is:

1. An apparatus for coupling one or more can carriers to a plurality of cans, comprising:

rails for guiding cans as the cans move through the apparatus;

two or more stop members, wherein at least two stop members are moved horizontally towards one another in between the rails to stop the cans at a selected position along the rails;

one or more push bodies that move along a length of the rails;

one or more push members coupled to the push bodies, wherein the push members can be inserted in between the rails to contact the cans and move the cans along a path between the rails;

a hopper configured to position at least one can carrier on top of the cans; and at least one roller positioned to provide a downward force on the at least one can carrier and attach the at least one can carrier to the cans as the cans are moved past the at least one roller by the push members.

2. The apparatus of claim 1, wherein the push bodies are coupled to second rails, and wherein the push bodies move parallel to the rails along the second rails.

3. The apparatus of claim 1, further comprising a divider attached to the hopper, wherein the divider is configured to align the cans to the at least one can carrier.

4. The apparatus of claim 1, wherein the stop members and the push members are pneumatically operated to move in between the rails.

5. The apparatus of claim 1, wherein the at least one roller comprises a roller having ends positioned in slots to allow the roller to move up and down relative to the cans.

6. The apparatus of claim 1, wherein the at least one roller comprises at least two rollers.

7. The apparatus of claim 6, wherein a first roller is in a fixed position and a second roller is movable up and down relative to the cans.

8. The apparatus of claim 1, further comprising a can carrier holder coupled to the hopper, wherein the can carrier holder is configured to provide can carriers to the hopper.

9. The apparatus of claim 1, further comprising a pulley system coupled to the push bodies, wherein the pulley system is configured to synchronize movement of the push bodies.

10. The apparatus of claim 1, further comprising at least one sensor configured to assess a position of at least one can in the apparatus.

11. The apparatus of claim 1, wherein the two or more stop members comprise at least a first stop member and at least a second stop member, and wherein the first stop member is positioned on a first side of the rails and the second stop member is positioned on a second side of the rails, the first and second sides of the rails being opposing sides of the rails.

12. A method for coupling one or more can carriers to a plurality of cans, comprising:

moving a plurality of cans along a path between a pair of rails;

stopping the cans using a pair of stop members inserted horizontally towards one another in a space between the pair of rails at a selected position along the rails;

after a selected number of cans are stopped against the stop members, inserting a pair of push members into the space between the pair of rails behind the selected number of cans along the path between the rails, wherein the push members are coupled to push bodies;

removing the stop members from the space between the pair of rails;

moving the push members along the path between the rails to push the selected number of cans towards the selected position along the path between the rails, wherein the push members are moved along the path by the push bodies, the push bodies moving parallel to the rails along a length of the rails;

positioning a can carrier above the selected number of cans with a hopper; and attaching the can carrier to tops of the selected number of cans, wherein the can carrier is attached to the selected number of cans using a downward force on the can carrier provided by at least one roller as the cans are pushed past the hopper along the path between the rails.

13. The method of claim 12, wherein the push bodies are moved parallel to the rails along second rails.

14. The method of claim 12, further comprising aligning the cans along the path between the rails as the cans move towards the stop members.

15. The method of claim 12, wherein the at least one roller moves up and down relative to the cans.

16. The method of claim 12, wherein the at least one roller comprises a first roller in a fixed position and a second roller that moves up and down relative to the cans.

17. The method of claim 12, wherein movement of the push bodies along the length of the rails is synchronized.

18. The method of claim 12, further comprising assessing a position of at least one can between the rails using at least one sensor.

19. The method of claim 12, further comprising after the selected number of cans moves past the selected position of the stop members along the path between the rails, inserting the stop members horizontally towards one another in the space between the pair of rails;

stopping an additional selected number of cans using the stop members;

after the additional selected number of cans are stopped against the stop members, inserting the push members into the space between the pair of rails behind the additional selected number of cans along the path between the rails;

removing the stop members from the space between the pair of rails;

moving the push members along the path between the rails to push the additional selected number of cans towards the selected position along the path between the rails; and positioning an additional can carrier above the additional selected number of cans with the hopper; and attaching the additional can carrier to the additional selected number of cans.

20. The method of claim 12, further comprising using a conveyor to move cans into the path between the rails.

* * * * *